US008161776B2

(12) United States Patent
Kim

(10) Patent No.: US 8,161,776 B2
(45) Date of Patent: Apr. 24, 2012

(54) LAUNDRY TREATMENT MACHINE AND DOOR SWITCH THEREOF

(75) Inventor: Kyung Tae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 901 days.

(21) Appl. No.: 12/230,703

(22) Filed: Sep. 3, 2008

(65) Prior Publication Data

US 2009/0064723 A1 Mar. 12, 2009

(30) Foreign Application Priority Data

Sep. 4, 2007 (KR) ..... 10-2007-0089504

(51) Int. Cl.
*D06F 39/14* (2006.01)
*H01H 13/06* (2006.01)

(52) U.S. Cl. ..... 68/12.26; 200/302.1; 200/61.81

(58) Field of Classification Search ..... 68/12.26, 68/196; 200/61.41, 61.42, 61.43, 61.62, 200/61.7, 61.76, 61.78, 61.81, 61.82, 302.1, 200/302.2

See application file for complete search history.

(56) References Cited

U.S. PATENT DOCUMENTS

| | | | | |
|---|---|---|---|---|
| 2,196,865 | A * | 4/1940 | Hutt | 200/61.82 |
| 2,219,337 | A * | 10/1940 | Schenendorf | 200/455 |
| 2,605,374 | A * | 7/1952 | Batcheller | 200/532 |
| 2,712,047 | A * | 6/1955 | Herterick | 200/530 |
| 3,249,726 | A * | 5/1966 | Long | 200/531 |
| 3,541,288 | A * | 11/1970 | Maas | 200/302.2 |
| 3,586,810 | A * | 6/1971 | Brown | 200/302.2 |
| 3,676,626 | A * | 7/1972 | Mitchell | 200/534 |
| 3,725,626 | A * | 4/1973 | Kruse | 200/295 |
| 3,742,162 | A * | 6/1973 | Wasemann | 200/61.62 |
| 3,887,777 | A * | 6/1975 | Nishino | 200/61.69 |
| 4,788,517 | A * | 11/1988 | Meister | 335/205 |
| 5,023,413 | A * | 6/1991 | Staples | 200/61.76 |
| 6,437,267 | B1 * | 8/2002 | Imai | 200/302.1 |
| 7,154,058 | B2 * | 12/2006 | Kim et al. | 200/302.1 |

FOREIGN PATENT DOCUMENTS

KR 20-0422722 7/2006

OTHER PUBLICATIONS

Machine translation of KR 20-042722, no date.*

* cited by examiner

*Primary Examiner* — Joseph L Perrin

(74) *Attorney, Agent, or Firm* — McKenna Long & Aldridge LLP

(57) ABSTRACT

A laundry treatment machine and a door switch thereof are provided. The door switch includes a switch housing unit, which is a predetermined distance apart from a cabinet. Thus, water flown along the cabinet may be able to be discharged through the space between the cabinet and the switch housing unit. Therefore, it is possible to minimize the infiltration of water into the switch housing unit and to improve the durability and the safety of the door switch.

8 Claims, 3 Drawing Sheets

LAUNDRY TREATMENT MACHINE AND DOOR SWITCH THEREOF

This application claims priority from Korean Patent Application No. 10-2007-0089504 filed on Sep. 4, 2007 in the Korean Intellectual Property Office, the disclosure of which is incorporated herein by reference in its entirety.

BACKGROUND OF THE INVENTION

1. Field of the Invention

The present invention relates to a laundry treatment machine and a door switch thereof, and more particularly, to a laundry treatment machine and a door switch thereof, which contributes to the improvement of the durability and the safety of a laundry treatment machine by preventing the infiltration of water into a switch housing unit.

2. Description of the Related Art

Laundry treatment machines are classified into washing machines removing dirt or dust from clothes or bedclothes by using water and detergent and using mechanical operations, dryers drying wet laundry by using a dry, hot wind generated by a heater and using mechanical operations, and combination washer dryers performing both a washing function and a drying function.

Drum-type washing machines, which are one type of washing machine, include a cabinet, a tub installed in the cabinet and holding wash water, and a drum installed in the tub and holding laundry.

The cabinet includes a cabinet main body which is open at the top and the front of the cabinet main body, a top cover which is installed on top of the cabinet main body, and a front panel which is installed at the front of the cabinet main body and has a laundry inlet/outlet hole formed at the front of the front panel. A door is connected to the front panel 8 by a hinge so as to open or close the laundry inlet/outlet hole. A door switch is provided on the front panel and determines whether the door is open or closed. The door switch includes a pressing pin which can be pressed by the door, and a switch housing unit which is connected to the pressing pin and includes a contact terminal.

Conventionally, water flown along the front panel is highly likely to infiltrate into the switch housing unit during a water leak test or during a typical washing operation. If water infiltrates into the switch housing unit, the contact terminal of the switch housing unit may be short-circuited, the door switch may malfunction due to an increase in voltage, and safety accidents may occur.

SUMMARY OF THE INVENTION

The present invention provides a laundry treatment machine and a door switch thereof, which contributes to the improvement of the durability and the safety of a laundry treatment machine by preventing the infiltration of water into a switch housing unit.

According to an aspect of the present invention, there is provided a door switch of a laundry treatment machine, the door switch including a switch contact unit which penetrates through a cabinet, is exposed at the front of the cabinet, and may or may not be placed in contact with a door according to whether the door is open or closed; a switch housing unit which is connected to the switch contact unit and is installed in the cabinet; and a water infiltration prevention unit which isolates the switch housing unit from the cabinet so that the switch housing unit and the cabinet can be a predetermined distance apart from each other, the water infiltration prevention unit preventing the infiltration of water flown along the cabinet into the switch housing unit.

The water infiltration prevention unit may include a coupler coupled to the cabinet and a plurality of connectors connecting the coupler and the switch housing unit.

The cabinet may include a switch hole and the coupler may be coupled to the cabinet by being inserted into the switch hole.

The coupler may be inserted into the switch hole in the direction of front and rear of the cabinet, and may be disposed at the front of the cabinet.

The coupler may be inserted into the switch hole in the direction of front and rear of the cabinet, and may be formed as a panel that covers the switch hole.

The connectors may include a plurality of ribs protruding from the switch housing unit toward the coupler and the ribs may be evenly spaced apart from one another.

The cabinet and the switch housing unit may be hook-coupled to each other.

The door switch may also include a mounting bracket, which is installed in the cabinet and is hook-coupled to the switch housing unit.

One of the switch housing unit and the mounting bracket may include a hook protruding therefrom, and the other one of the switch housing unit and the mounting bracket may include an engaging protrusion engaging with the hook.

According to another aspect of the present invention, there is provided a door switch of a laundry treatment machine, the door switch including a switch contact unit which penetrates through a cabinet, is exposed at the front of the cabinet, and may or may not be placed in contact with a door according to whether the door is open or closed; a switch housing unit which is connected to the switch contact unit and is installed in the cabinet; and a water infiltration prevention unit which isolates the switch housing unit from the cabinet so that the switch housing unit and the cabinet can be a predetermined distance apart from each other, the water infiltration prevention unit including a discharge unit and preventing the infiltration of water flown between the cabinet and the switch housing unit into the switch housing unit by discharging the water through the discharge unit.

According to another aspect of the present invention, there is provided a laundry treatment machine including a cabinet in which a tub and a drum are disposed, the cabinet including a laundry inlet/outlet hole formed at the front of the cabinet; a door which opens or closes the laundry inlet/outlet hole; a switch contact unit which penetrates through a cabinet, is exposed at the front of the cabinet, and may or may not be placed in contact with a door according to whether the door is open or closed; a switch housing unit which is connected to the switch contact unit and is installed in the cabinet; and a water infiltration prevention unit which isolates the switch housing unit from the cabinet so that the switch housing unit and the cabinet can be a predetermined distance apart from each other, the water infiltration prevention unit preventing the infiltration of water flown along the cabinet into the switch housing unit.

The water infiltration prevention unit may include a coupler coupled to the cabinet and a plurality of connectors connecting the coupler and the switch housing unit.

The cabinet may include a switch hole and the coupler may be coupled to the cabinet by being inserted into the switch hole.

The coupler may be inserted into the switch hole in the direction of front and rear of the cabinet, and may be disposed at the front of the cabinet.

The coupler may be inserted into the switch hole in the direction of front and rear of the cabinet, and may be formed as a panel that covers the switch hole.

The connectors may include a plurality of ribs protruding from the switch housing unit toward the coupler and the ribs may be evenly spaced apart from one another.

The cabinet and the switch housing unit may be hook-coupled to each other.

The door switch may also include a mounting bracket, which is installed in the cabinet and is hook-coupled to the switch housing unit.

One of the switch housing unit and the mounting bracket may include a hook protruding therefrom, and the other one of the switch housing unit and the mounting bracket may include an engaging protrusion engaging with the hook.

In short, the switch housing unit is a predetermined distance apart from the cabinet. Thus, water flown along the cabinet may be able to be discharged through the space between the cabinet and the switch housing unit. Therefore, it is possible to minimize the infiltration of water into the switch housing unit and to improve the durability and the safety of the door switch.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown, and taking a drum-type washing machine as an example of a laundry treatment machine.

Figure 1:
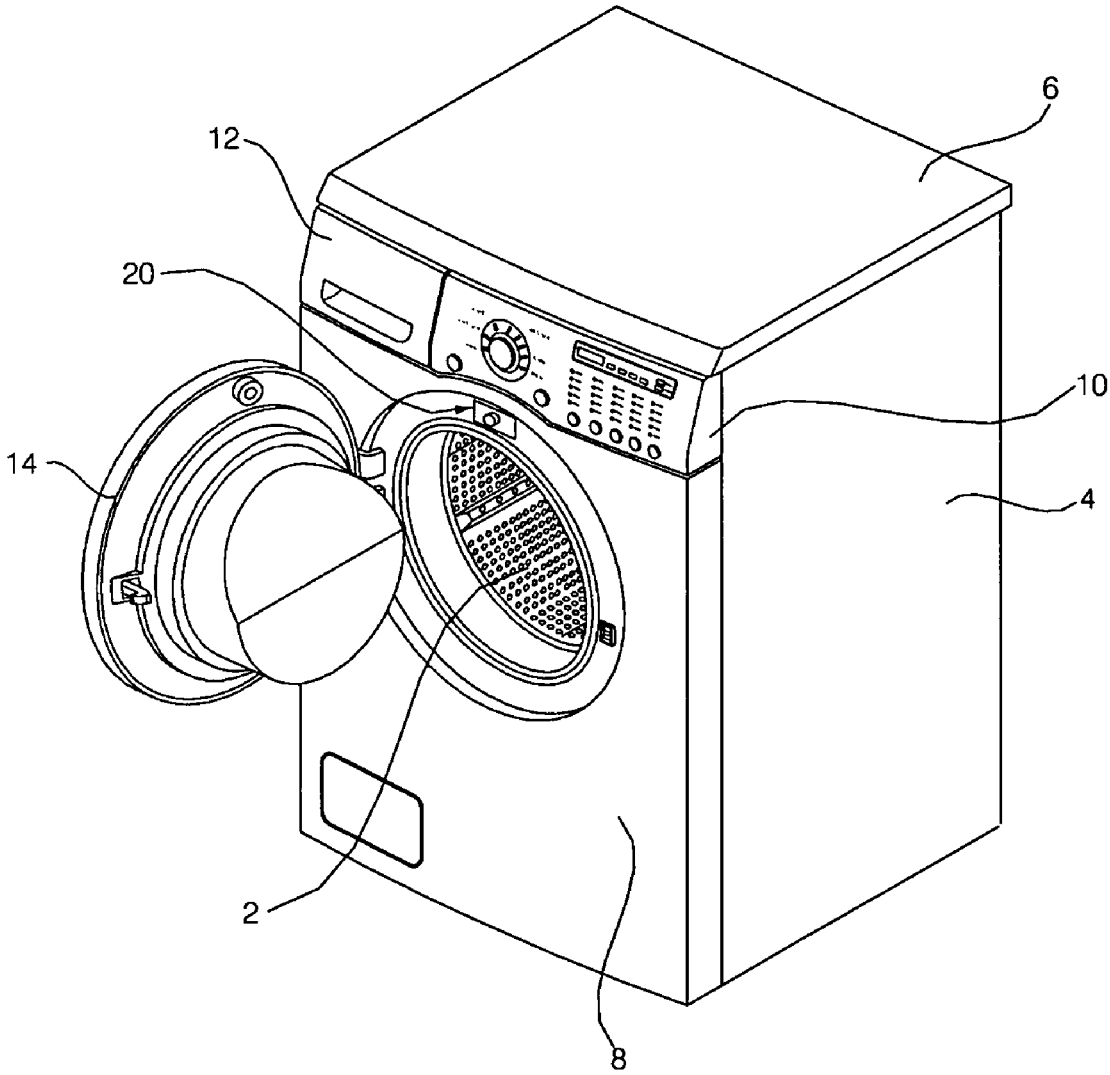
FIG. 1 illustrates a perspective view of a drum-type washing machine according to an exemplary embodiment of the present invention.

FIG. 1 illustrates a perspective view of a drum-type washing machine according to an exemplary embodiment of the present invention. Referring to FIG. 1, the drum-type washing machine includes a cabinet, which forms the exterior of the drum-type washing machine, a tub (not shown), which is installed in the cabinet and holds wash water, and a drum 2, which is installed in the tub and holds laundry.

The cabinet includes a cabinet main body 4, which is open at the top or the front of the cabinet main body 4, a top cover 6, which is installed so as to cover the top of the cabinet main body 4, and a front panel 8, which is installed so as to cover the front of the cabinet main body 4 and has a laundry inlet opening through which laundry is placed into the drum-type washing machine.

A control panel 10 is installed on one side of an upper portion of the front panel 8 and displays various information regarding the operating state of the drum-type washing machine. A detergent container 12 is installed on the other side of the upper portion of the front panel 8 and contains detergent.

A door 14 is installed on the front panel 8 by a hinge so as to open or close the laundry inlet/outlet hole. A door switch 20 is provided on the front panel 8 and determines whether the door 14 is open or closed.

Figure 2:
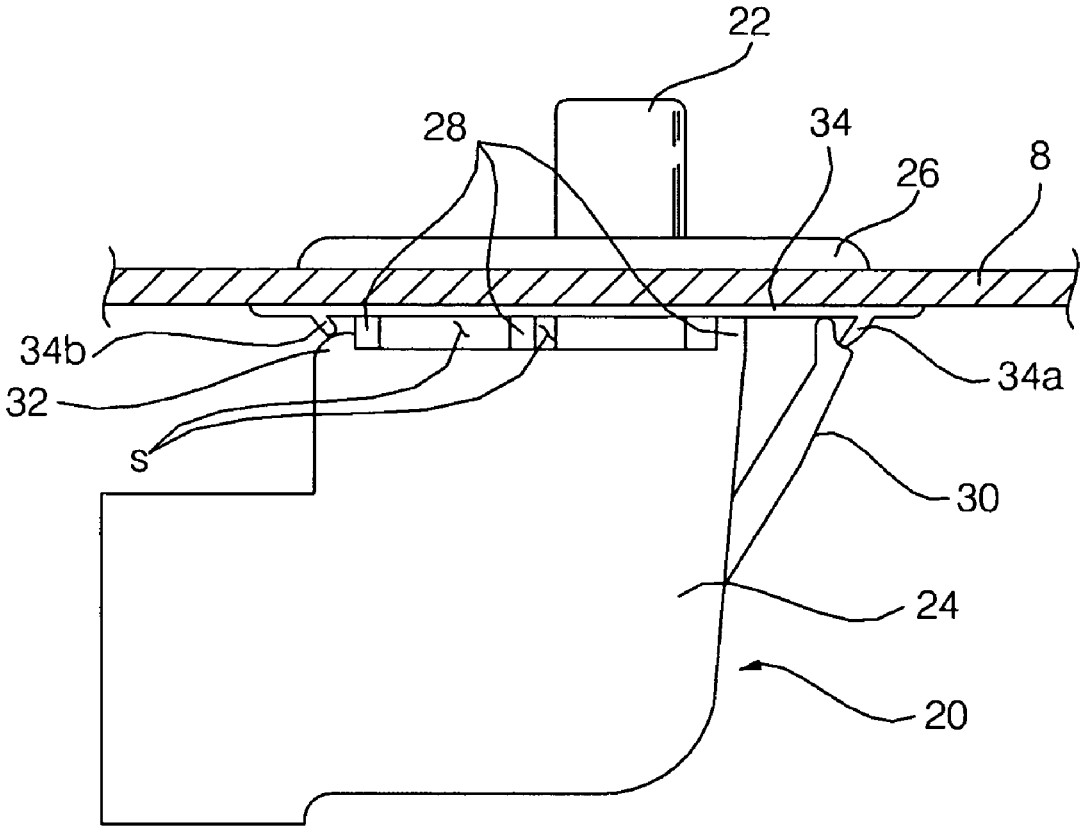
FIG. 2 illustrates a cross-sectional view of a door switch shown in FIG. 1.
Figure 3:
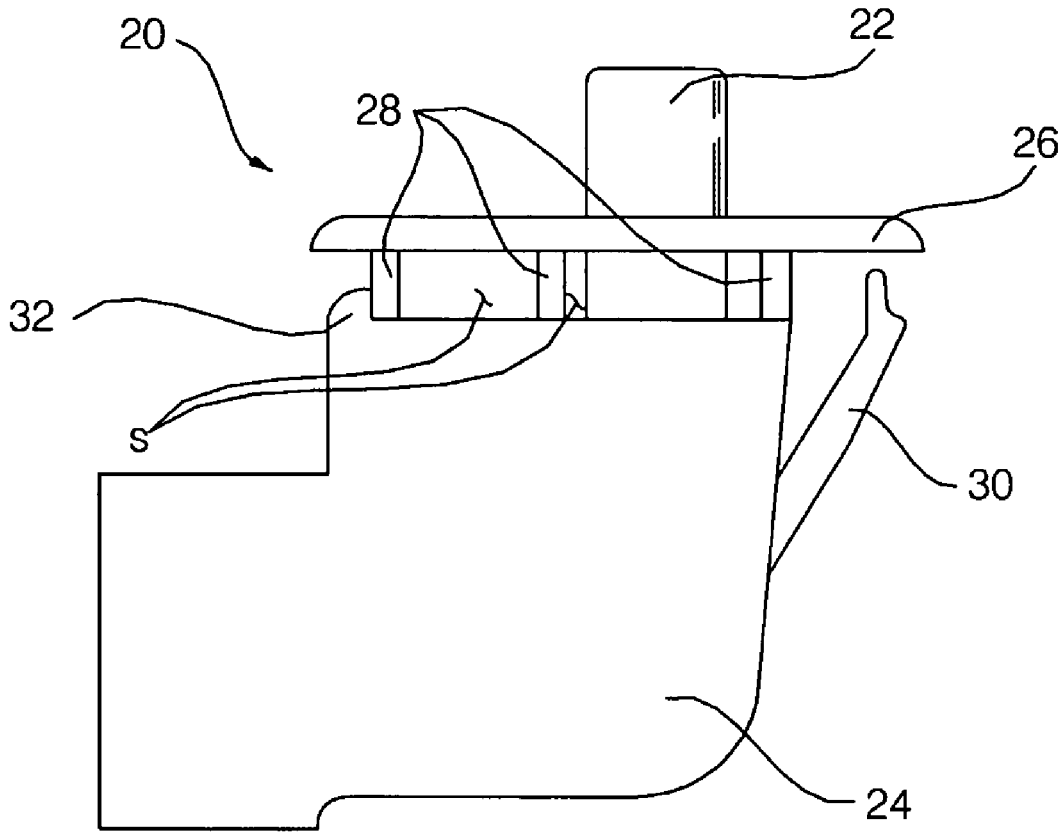
FIG. 3 illustrates a lateral view of the door switch shown in FIG. 2.

FIG. 2 illustrates a cross-sectional view of the door switch 20 shown in FIG. 1, and FIG. 3 illustrates a lateral view of the door switch 20 shown in FIG. 2. Referring to FIGS. 2 and 3, the door switch 20 includes a switch contact unit 22, which may or may not be placed in contact with the door 14 according to whether the door 14 is open or closed, a switch housing unit 24, which is connected to the switch contact unit 22, and a water infiltration prevention unit, which prevents the infiltration of water into the switch housing unit 24 by isolating the switch housing unit 24 from the front panel 8 so that the switch housing unit 24 from the front panel 8 can be a predetermined distance apart from each other.

The switch contact unit 22 protrudes from the switch housing unit 24 toward the door 14. The switch contact unit 22 may be implemented as a pressing pin that can be pressed by the door 14.

The switch housing unit 24 may be formed of a plastic material through injection molding. A number of electric elements such as terminals may be installed in the switch housing unit 24.

The water infiltration prevention unit includes a coupler 26, which is coupled to the front panel 8, and a plurality of connectors 28, which connect the coupler 26 and the switch housing unit 24.

The coupler 26 may be formed as a panel. The coupler 26 may be inserted into a switch hole (not shown) in the direction of front and rear of the cabinet on the front panel 8, and may be disposed at the front of the front panel 8. The coupler 26 may cover the switch hole.

The connectors 28 may be formed as ribs that protrude from the switch housing unit 24 toward the coupler 26. The connectors 28 may be evenly spaced apart from one another, and thus, a space s may be provided between the connectors 28. The spaces s may serve to prevent water from accumulating between the front panel 8 and the switch housing unit 24 by permitting water to flow there between.

A mounting bracket 34 is installed on the front panel 8, and is coupled to the switch housing unit 24. The mounting bracket 34 has a hole in the middle. The hole of the mounting bracket 34 corresponds to the switch hole. First and second engaging protrusions 34*a* and 34*b* are formed on either side of the hole of the mounting bracket 34.

The mounting bracket 34 and the switch housing unit 24 may be hook-coupled to each other by using a hook 30 and an engaging jaw 32. More specifically, the hook 30 protrudes from one side of the switch housing unit 24, and the engaging jaw 32 protrudes from the other side of the switch housing unit 24. The hook 30 may extend long enough to have elasticity.

The hook 30 may be coupled to the first engaging protrusion 34*a*, and the engaging jaw 32 may engage with the second engaging protrusion 34*b*.

The operation of the door switch 20 will hereinafter be described in detail.

Laundry is inserted into the drum 2, and then the door 14 is closed. Thereafter, the drum-type washing machine is driven by manipulating the control panel 10.

When the door 14 is closed, the door 14 presses the switch contact unit 22. If the switch contact unit 22 is pressed, the switch housing unit 24 may determine that the door 14 is closed.

If a liquid such as water flows toward the front panel 8 by accident or on purpose as part of a water leak test, the water may either flow downward along the front panel 8 or may flow through the spaces 6 between the connectors 28 away from the door switch 20.

Since the switch housing unit 24 is isolated from the front panel 8, it is possible to prevent the infiltration of water into switch housing unit 24 even when water flows along the front panel 8.

Even when water flows between the front panel 8 and the switch housing unit 24, the water is discharged through the spaces s, and thus, it is possible to prevent the infiltration of water into switch housing unit 24.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A door switch for use in a laundry machine including a cabinet and a door, the door switch comprising:

a switch contact unit that makes contact with the door when the door is closed;

a switch housing unit located inside the cabinet, wherein the switch contact unit protrudes from the switch housing unit and through the cabinet;

a water infiltration prevention unit configured such that the switch housing unit is spaced a predetermined distance apart from the cabinet and water is capable of flowing between the cabinet and the switch housing unit;

a mounting bracket which is in contact with an inner surface of the cabinet, wherein first and second engaging protrusions are formed on either side of the mounting bracket; and a hook and an engaging jaw protruding from either side of the switch housing unit such that the hook is coupled to the first engaging protrusion and the engaging jaw engages with the second engaging protrusion.

2. The door switch of claim 1, wherein the water infiltration prevention unit includes a coupler in contact with the cabinet and a plurality of connectors extending from the coupler to the switch housing unit.

3. The door switch of claim 2, wherein the infiltration prevention unit is inserted into a switch hole formed in the cabinet, and wherein the switch contact unit protrudes through a hole in the coupler.

4. The door switch of claim 3, wherein the coupler covers the switch hole.

5. A door switch of a laundry treatment machine, the door switch comprising:

a switch contact unit which penetrates through a cabinet, is exposed at the front of the cabinet, and may or may not be placed in contact with a door according to whether the door is open or closed;

a switch housing unit which is connected to the switch contact unit and is installed in the cabinet;

a water infiltration prevention unit configured such that the switch housing unit is spaced a predetermined distance apart from the cabinet and water is capable of flowing between the cabinet and the switch housing unit;

a mounting bracket which is in contact with an inner surface of the cabinet, wherein first and second engaging protrusions are formed on either side of the mounting bracket, and a hook and an engaging jaw protruding from either side of the switch housing unit such that the hook is coupled to the first engaging protrusion and the engaging jaw engages with the second engaging protrusion.

6. A laundry machine comprising:

a tub and a drum disposed within a cabinet, the cabinet including an opening through which laundry can be placed inside the drum;

a door which opens or closes the opening in the cabinet;

a switch contact unit that contacts the door when the door is closed;

a switch housing unit located inside the cabinet, wherein the switch contact unit protrudes from the switch housing unit and through the cabinet;

a water infiltration prevention unit which isolates the switch housing unit from the cabinet so that the switch housing unit and the cabinet can be a predetermined distance apart from each other, the water infiltration prevention unit preventing the infiltration of water flown along the cabinet into the switch housing unit;

a mounting bracket which is in contact with an inner surface of the cabinet, wherein first and second engaging protrusions are formed on either side of the mounting bracket; and a hook and an engaging jaw protruding from either side of the switch housing unit such that the hook is coupled to the first engaging protrusion and the engaging jaw engages with the second engaging protrusion.

7. The laundry treatment machine of claim 6, wherein the water infiltration prevention unit includes a coupler in contact with the cabinet and a plurality of connectors extending from the coupler to the switch housing unit.

8. The laundry treatment machine of claim 7, wherein the infiltration prevention unit is inserted into a switch hole formed in the cabinet, and wherein the switch contact unit protrudes through a hole in the coupler.

* * * * *